US012163526B2

(12) United States Patent
Vandewal et al.

(10) Patent No.: US 12,163,526 B2
(45) Date of Patent: Dec. 10, 2024

(54) COMPRESSOR DEVICE AND METHOD FOR CONTROLLING SUCH A COMPRESSOR DEVICE

(71) Applicant: ATLAS COPCO AIRPOWER, NAAMLOZE VENNOOTSCHAP, Wilrijk (BE)

(72) Inventors: Thomas Vandewal, Wilrijk (BE); Jeunfai Lo, Wilrijk (BE); Nathan Van Laere, Wilrijk (BE); Bert Korthoudt, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 0 days.

(21) Appl. No.: 18/032,742

(22) PCT Filed: Nov. 19, 2021

(86) PCT No.: PCT/IB2021/060732
§ 371 (c)(1),
(2) Date: Apr. 19, 2023

(87) PCT Pub. No.: WO2022/112910
PCT Pub. Date: Jun. 2, 2022

(65) Prior Publication Data

US 2023/0392603 A1 Dec. 7, 2023

(30) Foreign Application Priority Data

Nov. 26, 2020 (BE) ..... 2020/5855

(51) Int. Cl.
*F25B 41/34* (2021.01)
*F04B 49/06* (2006.01)
(Continued)

(52) U.S. Cl.
CPC ..... *F04D 17/10* (2013.01); *F04B 49/065* (2013.01); *F04D 25/06* (2013.01); *F04D 27/001* (2013.01);
(Continued)

(58) Field of Classification Search
CPC ..... F04D 29/5833
See application file for complete search history.

(56) References Cited

U.S. PATENT DOCUMENTS 3,599,440 A * 8/1971 Melion ..... F25B 41/20 62/278
9,115,921 B2 * 8/2015 Ueda ..... F25B 1/053
(Continued)

FOREIGN PATENT DOCUMENTS

EP 2 594 865 A1 5/2013
JP 2018-013319 A 1/2018
(Continued)

OTHER PUBLICATIONS

International Search Report for PCT/IB2021/060732 dated Jan. 24, 2022 (PCT/ISA/210).
(Continued)

*Primary Examiner* — Kayla McCaffrey
(74) *Attorney, Agent, or Firm* — Sughrue Mion, PLLC

(57) ABSTRACT

The present invention relates to a compressor device (1) comprising:

Figure 1:
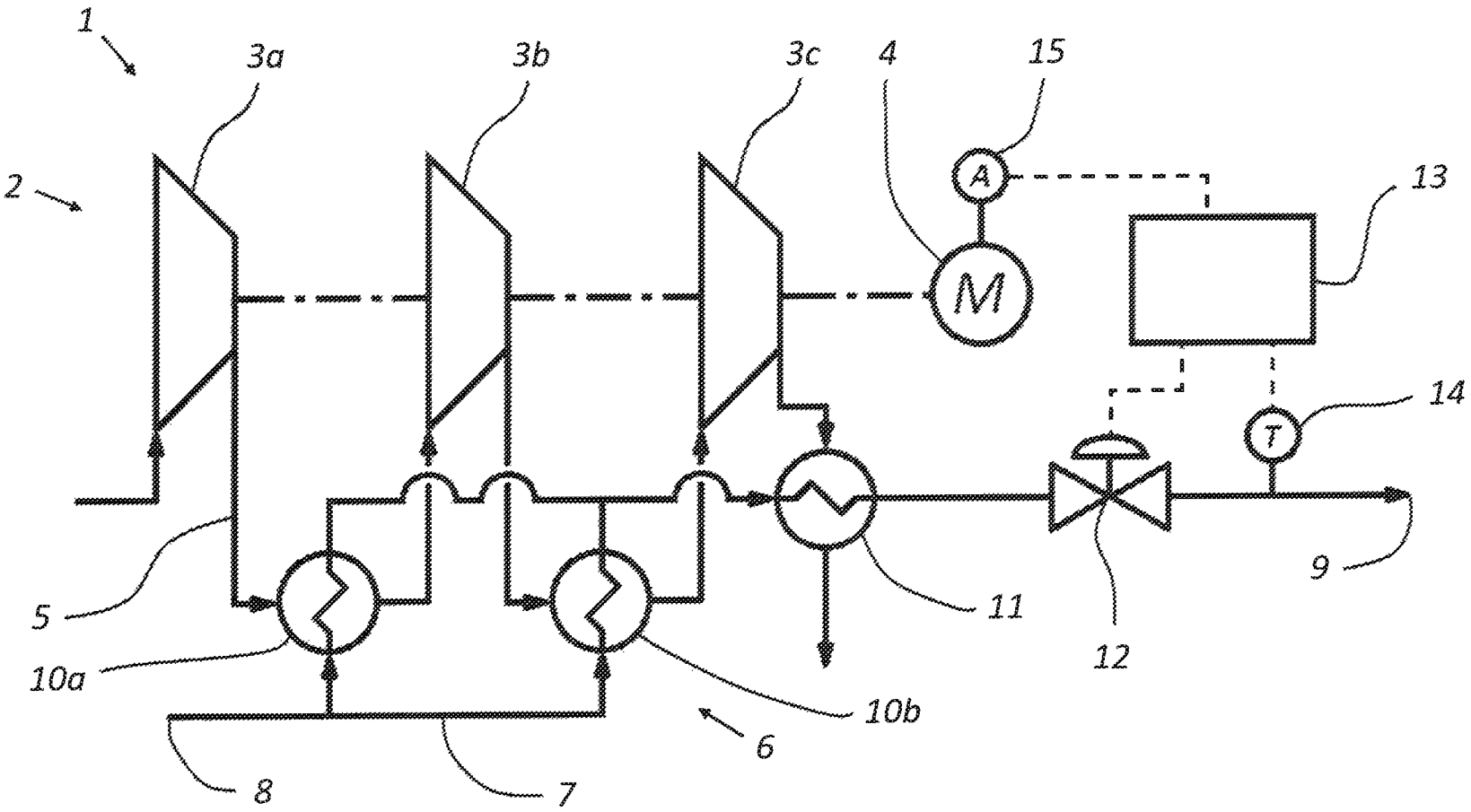

a compressor installation (2) having at least one compressor element (3*a*, 3*b*, 3*c*) for compressing a suctioned gas, the compressor element (3*a*, 3*b*, 3*c*) being driven by an electric motor (4);

a heat recuperation system (6) for recuperating heat from a compressed gas resulting from the compression of the suctioned gas, (Continued)

the heat recuperation system (6) comprising a piping network (7) having an inlet (8) and an outlet (9) for a coolant, said piping network (7) being provided at this inlet (8) or outlet (9) with control means with a flow rate control state variable for modifying a first flow rate of the coolant in the piping network (7); and a control unit (13) which adjusts the flow rate control state variable of the control means on the basis of a drive current of the electric motor (4) or on the basis of a second flow rate of the suctioned gas such that a temperature $T_{w,out}$ at the outlet (9) of the piping network (7) is driven to a predefined level.

29 Claims, 5 Drawing Sheets

(51) Int. Cl.

| | |
|---|---|
| ***F04D 17/10*** | (2006.01) |
| ***F04D 25/06*** | (2006.01) |
| ***F04D 27/00*** | (2006.01) |
| ***F04D 27/02*** | (2006.01) |
| ***F04D 29/58*** | (2006.01) |
| ***F25B 1/10*** | (2006.01) |
| *F04B 41/06* | (2006.01) |

(52) U.S. Cl.
CPC ..... *F04D 27/0246* (2013.01); *F04D 27/0253* (2013.01); *F04D 27/0261* (2013.01); *F04D 27/0284* (2013.01); *F04D 29/5833* (2013.01); *F25B 1/10* (2013.01); *F04B 41/06* (2013.01); *F04B 2203/0201* (2013.01); *F04B 2205/09* (2013.01); *F04B 2205/11* (2013.01); *F25B 2700/151* (2013.01)

(56) References Cited

U.S. PATENT DOCUMENTS

| | | | | |
|---|---|---|---|---|
| 9,157,654 | B2 * | 10/2015 | Nakayama | F24H 4/02 |
| 9,976,569 | B2 * | 5/2018 | Janssens | F04D 29/5833 |
| 2016/0187893 | A1 * | 6/2016 | Bergh | G05D 16/2046 137/565.11 |
| 2016/0238284 | A1 * | 8/2016 | Krystad | F25B 49/022 |
| 2019/0024957 | A1 | 1/2019 | Wajima et al. | |

FOREIGN PATENT DOCUMENTS

| | | | |
|---|---|---|---|
| KR | 10-2012-0092417 | A | 8/2012 |
| WO | 2011/088527 | A2 | 7/2011 |

OTHER PUBLICATIONS

Written Opinion for PCT/IB2021/060732 dated Jan. 24, 2022 (PCT/ISA/237).

* cited by examiner

COMPRESSOR DEVICE AND METHOD FOR CONTROLLING SUCH A COMPRESSOR DEVICE

CROSS REFERENCE TO RELATED APPLICATIONS

This application is a National Stage of International Application No. PCT/IB2021/060732 filed Nov. 19, 2021, claiming priority based on Belgian Patent Application No. 2020/5855 filed Nov. 26, 2020.

The present invention relates to a compressor device, wherein the compressor device comprises a compressor installation with at least one compressor element for compressing a suctioned gas, and a heat recuperation system for recuperating heat from a compressed gas resulting from the compression of the suctioned gas.

The invention relates more specifically to a compressor device wherein:

- the compressor element is driven by an electric motor;
- the heat recuperation system comprises a piping network having an inlet and an outlet for a coolant, which piping network is also provided at this inlet or outlet with control means with a flow rate control state variable for modifying a first flow rate of the coolant in the piping network; and
- the compressor device also comprises a control unit that adjusts the flow rate control state variable of the control means based on a driving current of the electric motor or a second flow rate of the suctioned gas, respectively, in such a way that a temperature of the coolant at the outlet of the piping network is driven to a predefined level.

A 'first flow rate' or a 'second flow rate' is always understood to mean a volumetric flow rate within the scope of this invention.

In this regard, the 'first flow rate of the coolant in the piping network' means a total coolant flow rate of the coolant in the piping network. The 'second flow rate of the suctioned gas' refers to a total gas flow rate of the suctioned gas.

Compressor devices are already known in the prior art with a compressor installation in which a suctioned gas is compressed by a compressor element on the one hand, and, on the other hand, a heat recuperation system for recuperating heat generated in the compressor installation.

This heat is primarily generated as compression heat inside the compressor element in which the suctioned gas is compressed, in the motor by which this compressor element is driven and/or in the bearings of the compressor device.

In the case that the compressor device comprises only a single compressor element, the compression heat withdrawn by means of an aftercooler which is in fluid communication with an outlet of the compressor element for a compressed gas resulting from the compression of the suctioned gas, for example.

In the case that the compressor installation comprises multiple consecutive compressor elements, the consecutive compressor elements being in fluid communication with each other by means of a pipeline for the gas, the compression heat is withdrawn, for example, by means of one or more intercoolers included in the pipeline and/or by means of an aftercooler which is in fluid communication with an outlet of the last of the consecutive compressor elements.

The one or more intercoolers and/or the aftercooler are provided with coolant for withdrawing the compressed heat from the gas by means of a cooling circuit. In this regard, the coolant can heat up to a certain temperature.

The motor and/or bearings of the compressor installation are typically also cooled using the same cooling circuit.

There has been a growing trend in recent years not to simply allow absorbed heat in the coolant to be lost into the compressor installation surroundings, but to put the heated coolant to good use in all kinds of applications such as, for example, heating buildings or preheating fluid flows in an industrial process.

To this end, the temperature of the heated coolant must be able to be driven to a certain predefined level with a certain level of accuracy.

The more components in the compressor installation are cooled using the cooling circuit, the more difficult and less stable a control of the temperature of the heated coolant will be.

Moreover, the control must also take varying load conditions of the compressor installation into consideration. The lower/higher these load conditions are, the less/more compression heat will be generated during a period of time and the less/more heat will be able to be absorbed by the coolant during said time period.

The impact of lower/higher load conditions is typically counterbalanced by decreasing/increasing a coolant flow rate in the cooling circuit by means of an adjustable valve in the cooling circuit.

Traditionally, a control of this adjustable valve is done on the basis of a flow meter in the cooling circuit. Such a flow meter, however, has the disadvantage of being expensive.

The present invention has the objective of providing a solution for at least one of the aforementioned and/or other disadvantages.

To this end, the object of the present invention is a compressor device comprising:

- a compressor installation with at least one compressor element for compressing a suctioned gas, the compressor element being driven by an electric motor; and
- a heat recuperation system for recuperating heat from a compressed gas resulting from the compression of the suctioned gas, the heat recuperation system comprising a piping network with an inlet and an outlet for a coolant, and the piping network being provided at the inlet or the outlet with control means with a flow rate control state variable for modifying a first flow rate of the coolant in the piping network, characterized in that the compressor further comprises measuring means for determining an actual value for a drive current of the electric motor or a second flow rate of the suctioned gas, respectively; and the compressor device comprises a control unit which is configured such that it is able to:

- receive the aforementioned actual value;
- determine a desired value for the first flow rate at which the coolant temperature at the outlet of the piping network can be driven to a predefined level on the basis of the actual value; and
- adjust the desired value to the first flow rate on the basis of a characteristic which provides a relationship between the flow rate control state variable of the control means and the first flow rate.

An advantage is that by determining the desired value for the first flow rate based on the electric motor driving current or the second flow rate of the suctioned gas respectively, and by adjusting the flow rate control state variable on the basis of the characteristic, a flow rate meter is no longer necessary in the piping network of the heat recuperation system for driving the flow rate control state variable.

In a preferred embodiment of the compressor device according to the invention, the control means comprise an adjustable valve, the characteristic being a valve characteristic of the adjustable valve and the flow rate control state variable being an opening position of the adjustable valve.

An advantage of such an adjustable valve is that it can be controlled in a simple and inexpensive manner, and can be installed at the inlet or outlet of the piping network.

In a further preferred embodiment of the compressor device of the invention, the control unit is configured so as to determine the desired value for the first flow rate on the basis of the actual value and on the basis of a relationship between the desired value for the first flow rate on the one hand, and the drive current of the electric motor or the second flow rate of the suctioned gas respectively on the other hand.

In a more preferred embodiment of the compressor device, the control unit is configured so as to determine the desired value for the first flow rate on the basis of the actual value and on a positive, directly proportional relationship between the desired value for the first flow rate on the one hand, and the drive current of the electric motor or the second flow rate of the suctioned gas respectively on the other hand.

Such a positive, directly proportional relationship forms a basic mathematical function that allows the desired value for the first flow rate to be determined quickly and easily without in this regard demanding an excessive amount of computational power in the control unit.

In a further preferred embodiment of the compressor device of the invention, the compressor installation is a multistage compressor installation having multiple compressor elements.

A multistage compressor installation is interesting for heat recuperation because a pressure ratio between an input and output of such a multistage compressor installation is in general relatively high when compared to the pressure ratio for a compressor installation having only one compressor element. Because of this, the compression heat generated is also relatively large, such that the coolant in the heat recuperation system can be heated to a relatively high temperature, which relatively high temperature may be a requirement for certain consumers of the recuperated compression heat.

In a more preferred embodiment of the compressor device according to the invention, the compressor elements are driven by the electric motor.

By driving all the compressor elements with one and the same electric motor, only one actual value for the drive current has to be determined, such that the cost of measuring devices can be restricted.

Moreover, only one actual value for the drive current needs to be received by the control unit, such that complex control algorithms and a therewith associated excessive amount of computational power in the control unit can be avoided.

In a further more preferred embodiment of the compressor device according to the invention, the compressor installation is a multistage compressor installation having multiple consecutive compressor elements, the consecutive compressor elements being in fluid communication with each other by means of a pipe for the gas, said pipe incorporating one or more intercoolers between the consecutive compressor elements for cooling the gas.

The aforementioned intercoolers are incorporated in parallel or in series between the inlet and the outlet of the piping network.

In an even more preferred embodiment of the compressor device according to the invention, an aftercooler for cooling the compressed gas is provided downstream of the multistage compressor installation, the aftercooler being incorporated between the inlet and the outlet in series with respect to the intercoolers in the piping network.

As a result, the compressed heat generated in a final compressor element of the multistage compressor installation is also used to heat the coolant in the piping network.

In a further even more preferred embodiment of the compressor device according to the invention, the multistage compressor installation comprises at least three consecutive compressor elements and at least one intercooler in the pipe between two directly consecutive compressor elements of these three consecutive compressor elements.

There are at least two intercoolers in such a compressor device, resulting in more compression heat potentially being able to be recuperated by the heat recuperation system than in a compressor device with only one intercooler.

In a further preferred embodiment of the compressor device according to the invention, the compressor device comprises a memory unit for storing corresponding reference values for the flow rate control state variable of the control means on the one hand, and for the drive current of the electric motor or the second flow rate of the suctioned gas on the other hand, the temperature of the coolant being driven to the predefined level at the outlet of the piping network.

At a later moment, these reference values can help to determine the desired value for the first flow rate based on the actual value.

On the basis of such a pair of corresponding reference values for a flow rate control state variable of the control means on the one hand, and the drive current of the electric motor or the second flow rate of the suctioned air respectively on the other hand, one or more parameters in a relationship between the desired value for the first flow rate on one hand, and the drive current of the electric motor or the second flow rate of the suctioned gas respectively on the other hand, can also be determined by means of the characteristic.

In a positive directly proportional relationship, a proportionality constant, for example, can be determined.

In the event of a change in the load conditions of the compressor installation and consequently the drive current of the electric motor and the second flow rate of the suctioned gas, a related required change of the first flow rate of coolant can, on the basis of the aforementioned positive directly proportional relationship with the determined proportionality constant, be calculated to drive the temperature of the coolant at the outlet of the piping network to the predefined level.

An associated change of the flow rate control state variable of the control means can then be calculated by using the characteristic on the basis of the aforementioned required change of the first flow rate of coolant.

The invention also relates to a heat recuperation system for use in a compressor device according to one of the embodiments described above.

It goes without saying that such a heat recuperation system has the same advantages as the above-described embodiments of the compressor device according to the invention.

Finally, the invention also relates to a method for controlling a compressor device, the compressor device comprising a compressor installation having at least one compressor element for compressing a suctioned gas, the compressor element being driven by an electric motor; and a heat recuperation system for recuperating heat from a compressed gas resulting from the compression of the suctioned gas, the heat recuperation system comprising a piping network with an inlet and an outlet for a coolant, and the piping network being provided at the inlet or the outlet with control means with a flow rate control state variable for modifying a first flow rate of the coolant in the piping network, characterized in that the method comprises the following steps:

determining an actual value for an electric motor drive current or a second flow rate of the suctioned gas; and determining a desired value for the first flow rate at which a temperature of the coolant at the outlet of the piping network can be controlled to a predefined level based on the aforementioned actual value; and adapting the flow rate control state variable of the control means to the desired value for the first flow rate on the basis of a characteristic which provides a relationship between the flow rate control state variable of the control means and the first flow rate.

It goes without saying that this method has the same advantages as the above-described compressor device according to the invention.

In a preferred embodiment of the method according to the invention, the aforementioned predefined level lies between 60° C. and 90° C.

This temperature level is often required by consumers of heat recuperated from the compressed gas by the heat recuperation system.

In a further preferred embodiment of the method according to the invention, a temperature of the coolant at the inlet of the piping network lies between 5° C. and 35° C.

The lower the temperature of the coolant at the inlet, the faster and greater the heat exchange between the coolant and the compressed gas.

This temperature of the coolant at the inlet must of course not be chosen at such a low level that the coolant would freeze before it can absorb the heat from the compressed gas, which would cause blockages in the piping network and therefore failure of the heat recuperation system.

In a preferred embodiment of the method according to the invention, when the electric motor is driven with a certain reference drive current or when the compressor installation suctions a certain reference flow rate of the suctioned gas, respectively, an initial reference value for the flow rate control state variable of the control means will be stored when the temperature of the coolant at the outlet of the piping network, during a first predefined period, remains within a first predefined maximum absolute deviation with respect to the predefined level.

A 'maximum absolute deviation' in this context means that, even if the maximum absolute deviation is expressed as a positive maximum deviation, the maximum absolute deviation, besides a maximum positive deviation, also represents a maximum negative deviation.

Based on this initial reference value for the flow rate control state variable of the control means and respectively the reference drive current or the reference flow rate, for instance a proportionality constant for the positive directly proportional relationship between, on the one hand, the desired value for the first flow rate and, on the other hand, the drive current of the electric motor or the second flow rate of the suctioned gas respectively, can be determined by means of the characteristic.

In the event of a change in the load conditions of the compressor installation and consequently the drive current of the electric motor and the second flow rate of the suctioned gas, a related required change in the first flow rate of coolant can, on the basis of the aforementioned positive directly proportional relationship with the determined proportionality constant, then be calculated to drive the temperature of the coolant at the outlet of the piping network to the predefined level.

An associated change of the flow rate control state variable of the control means can then be calculated by using the characteristic on the basis of the aforementioned required change of the first flow rate of coolant.

Preferentially, the initial reference value for the flow rate control state variable of the control means will be updated at predefined times to a new reference value, when:

on the one hand, the temperature of the coolant at the outlet of the piping network remains within a second predefined maximum absolute deviation with respect to the predefined level during a second predefined period; and on the other hand, during the second predefined period, the driving current remains within a predefined maximum absolute relative deviation with respect to the reference drive current or, respectively, the second flow rate remains within the predefined maximum absolute relative deviation with respect to the reference flow rate.

As a result, a control of the control means becomes more accurate, for example by a more accurate determination of the proportionality constant.

A 'maximum relative deviation' in this context means that the maximum deviation is expressed as a relative percentage proportion of a parameter to which the maximum deviation applies.

Figure 2A:
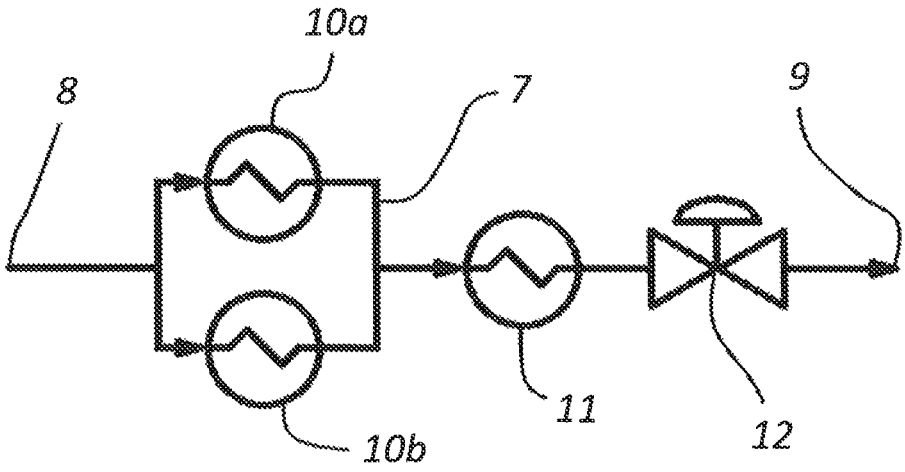
Figure 2B:
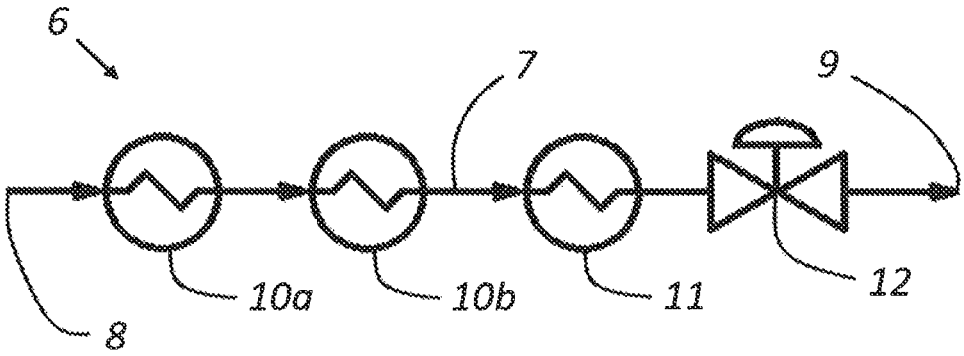

Hereafter, with the understanding to better demonstrate the characteristics of the invention, some preferred embodiments of a compressor device according to the invention and a method for controlling such a compressor device according to the invention are described with reference to the accompanying drawings, in which:

FIG. 1 schematically shows a compressor device according to the invention;

FIG. 2*a* schematically shows a heat recuperation system of the compressor device in FIG. 1;

FIG. 2*b* schematically shows a first variant of the heat recuperation system in FIG. 2*a;*

Figure 2C:
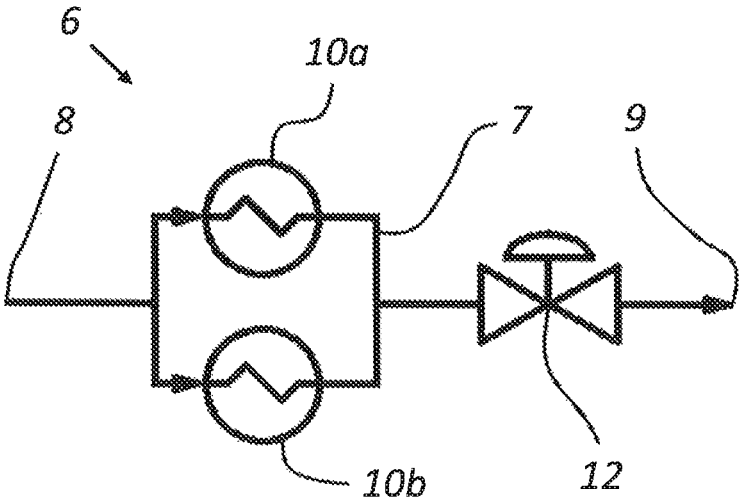

FIG. 2*c* schematically shows a second variant of the heat recuperation system in FIG. 2*a;*

Figure 2D:
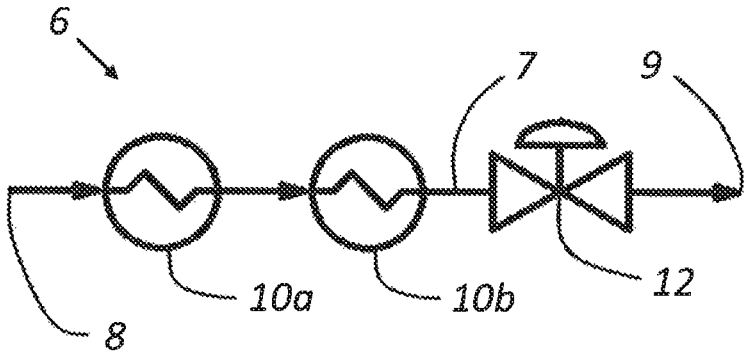

FIG. 2*d* schematically shows a third variant of the heat recuperation system in FIG. 2*a;*

Figure 3A:
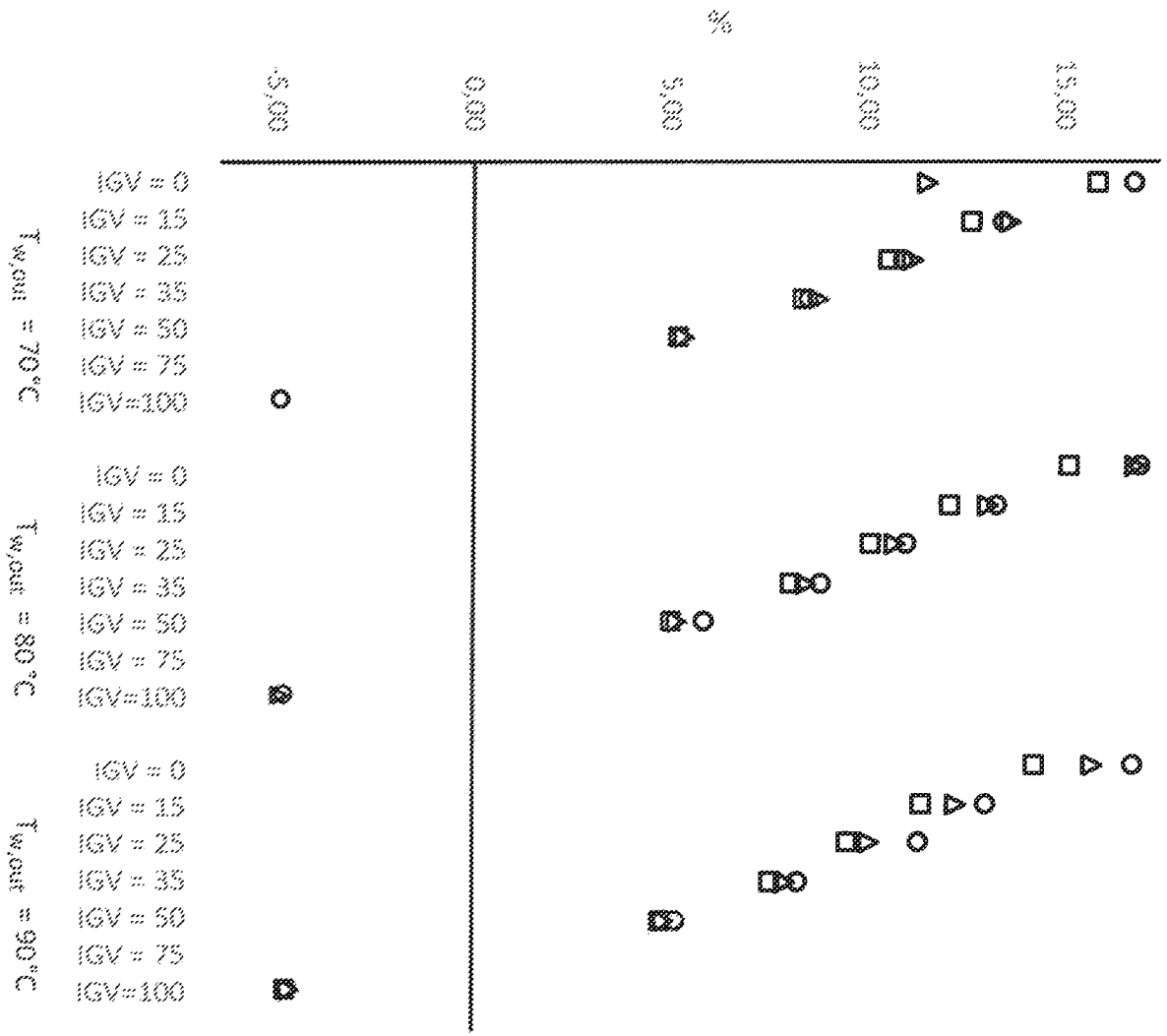
Figure 3B:
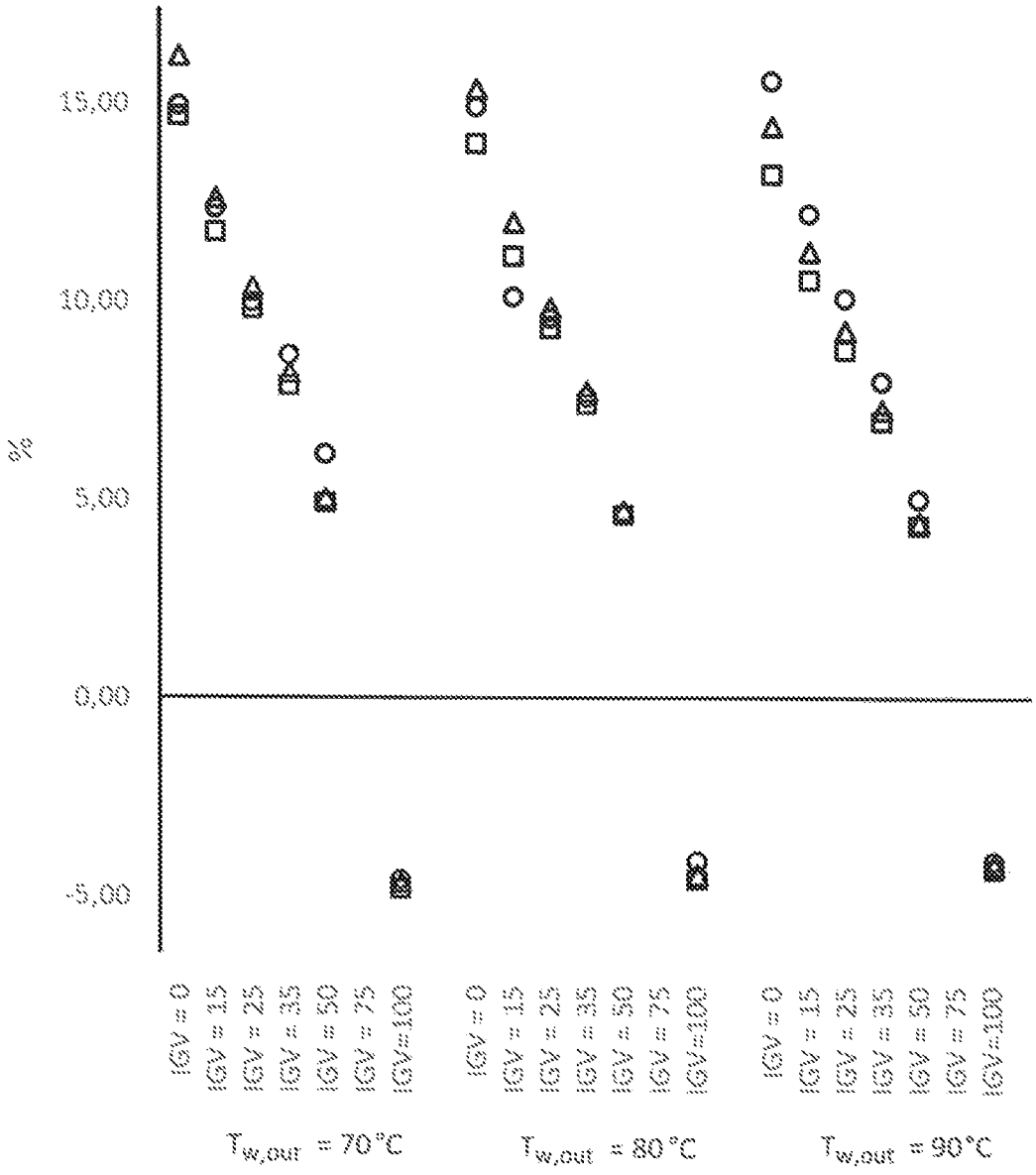

FIGS. 3*a* and 3*b* show a functional relationship between a relative change of the drive current, of the second flow rate of suctioned gas and of a required desired first flow rate by the adjustable valve on the one hand, and a measure for load conditions of the compressor device in FIG. 1 on the other hand.

FIG. 1 schematically represents a compressor device 1 according to the invention.

The compressor device 1 comprises a compressor installation 2, in this case a multistage compressor installation with three consecutive compressor elements 3*a*, 3*b*, 3*c*, in which gas sucked in by said compressor installation 2 is increasingly compressed.

Within the scope of the invention it is not excluded that said compressor installation 2 comprises another number of compressor elements.

In this case, the compressor elements 3*a*, 3*b*, 3*c* are turbocompressor elements.

The plurality of consecutive compressor elements 3*a*, 3*b*, 3*c* are driven by an electric motor 4 and are in fluid communication with each other by means of a pipe 5 for the gas.

At an inlet of a downstream first compressor element 3*a*, inlet vanes are provided which, upon being less or more closed, increase or decrease a second flow rate of the suctioned gas.

The compressor device 1 further comprises a heat recuperation system 6 for recuperating heat from the compressed suctioned gas.

This heat recuperation system 6 comprises a piping network 7 having an inlet 8 and an outlet 9 for a coolant.

Water, for example, can be used for the coolant, because of a relatively high specific heat capacity and relatively low-corrosive properties of water.

In the pipe 5, between each two directly consecutive compressor elements 3*a*, 3*b* and 3*b*, 3*c*, an intercooler 10*a*, 10*b* is incorporated for cooling the gas by means of heat exchange with the coolant in the piping network 7.

Besides the intercoolers 10*a*, 10*b*, downstream from the compressor installation 2, an aftercooler 11 is provided for cooling the gas compressed by a downstream last of the consecutive compressor elements 3*a*, 3*b*, 3*c* by means of heat exchange with the coolant.

The heat exchange between the coolant and the gas is controlled on the basis of a first flow rate of the coolant in the piping network 7 by means of an adjustable valve 12 provided at the outlet 9 of the piping network 7.

Within the scope of the invention, it is not excluded that the adjustable valve 12 is provided at the inlet 8 of the piping network 7.

Within the scope of the invention, it is also not excluded that other control means are applied for modifying the first coolant flow rate in the piping network 7, as, for example, an adjustable pump.

An opening position of the adjustable valve 12 is driven by a control unit 13 in such a way that a temperature $T_{w,out}$ at the outlet 9 of the piping network 7 can be driven to a predefined level.

The temperature $T_{w,out}$ at the outlet 9 is measured by means of a temperature sensor 14 provided at the outlet 9 of the piping network 7.

In this case, the control unit 13 receives a signal with information regarding an actual value for a drive current of the electric motor 4. Said actual value is determined in this case by means of an ammeter 15.

Based on this signal, the opening position of the adjustable valve 12 is controlled during operation of the compressor device 1.

Within the scope of the invention, the control unit 13 can alternatively or additionally receive a signal with information about an actual value for the second flow rate of the suctioned gas.

Measuring devices for directly determining the actual value of this second flow rate can be provided at the entry of the first compressor element 3*a*.

This actual value for the second flow rate of the suctioned gas can also be determined indirectly by means of measuring devices positioned further downstream for measuring a gas flow rate in the compressor installation 2 downstream of the entry of the first compressor element 3*a*. This measured gas flow rate then still has to be converted in terms of the second flow rate of the suctioned gas on the basis of the pressure ratios over the compressor elements upstream of the measuring devices positioned further downstream.

FIG. 2*a* schematically represents the heat recuperation system 6 of the compressor device 1 in FIG. 1.

The intercoolers 10*a*, 10*b* are incorporated mutually parallel between the inlet 8 and the outlet 9 in the piping network 7.

The aftercooler 11 is incorporated in the piping network 7 between the inlet 8 and the outlet 9 in series with respect to the intercoolers 10*a*, 10*b*.

FIG. 2*b* schematically represents a first variant of the heat recuperation system 6 in FIG. 2*a*.

The intercoolers 10*a*, 10*b* in this first variant are arranged mutually in series between the inlet 8 and the outlet 9 in the piping network 7.

Here too, the aftercooler 11 is incorporated between the inlet 8 and the outlet 9 in series with respect to the intercoolers 10*a*, 10*b* in the piping network 7.

FIG. 2*c* schematically represents a second variant of the heat recuperation system 6 in FIG. 2*a*.

Here too, the intermediate coolers 10*a*, 10*b* are mutually incorporated in parallel between the inlet 8 and the outlet 9 in the pipe network 7.

No aftercooler is incorporated in this second variant, however.

FIG. 2*d* schematically represents a third variant of the heat recuperation system 6 in FIG. 2*a*.

In this third variant, the intercoolers 10*a*, 10*b* are mutually incorporated in series between the inlet 8 and the outlet 9 in the piping network 7.

In this third variant, an aftercooler is also not incorporated.

It is not excluded within the scope of the invention that the heat recuperation system 6 comprises more than two intercoolers mutually incorporated in series and/or parallel between the inlet 8 and the outlet 9 in the piping network 7, whether or not with an aftercooler 11 incorporated in series with respect to the intercoolers in the piping network 7.

EXAMPLE

In FIG. 3*a*, functional relationships are illustrated for the compressor device 1 in FIG. 1 between

- a closure ratio (IGV) of the inlet vanes provided at the entry of the first compressor element 3*a* on the one hand; and
- on the other hand, with respect to a required drive current at an inlet vane closure ratio of 75%, a relative percentage change in the drive current, represented by means of triangle symbols;

with respect to a value for the second flow rate of suctioned gas at an inlet vane closure ratio of 75%, a relative percentage change in the second flow rate of suctioned gas, represented by means of square symbols; and, with respect to a desired value for the first flow rate through the adjustable valve 12 at an inlet vane closure ratio of 75%, a relative percentage change in the desired value for the first flow rate that should flow through the adjustable valve 12 to drive the temperature $T_{w,out}$ of the coolant at the outlet 9 of the piping network 7 to a predefined level, represented by means of circle symbols.

The aforementioned relative percentage change in the drive current, the second flow rate of the suctioned gas and the desired value for the first flow rate by the adjustable valve 12 are measured at values for the closure ratios of 0%, 15%, 25%, 35%, 50% and 100%.

An increase in the closing ratio of the inlet vanes at the entry of the first compressor element 3*a* corresponds to a reduction in the second flow rate of the gas suctioned by the compressor device 1 and, consequently, a reduction in the load conditions of the compressor device 1.

In particular, when the value of the closing ratio is equal to 0%, the compressor device 1 operates at a maximum second flow rate of suctioned gas and thus maximum load conditions.

When the value of the closing ratio is equal to 100%, the compressor device 1 operates at a zero flow rate of suctioned gas and thus minimum load conditions.

The temperature of the coolant at the inlet 8 of the piping network 7 is 25° C.

The predefined level for the temperature $T_{w,out}$ of the coolant at the outlet 9 is fixed at a temperature of 70° C., 80° C. or 90° C.

Each of the functional relationships in FIG. 3*a* corresponds to one of these temperature values, as indicated.

From the functional relationships in FIG. 3*a*, it can be concluded that there is a positive directly proportional relationship between, on the one hand, the drive current or the second flow rate of the suctioned gas respectively, and, on the other hand, the desired value of the first flow rate that should flow through the adjustable valve 12 to drive the temperature $T_{w,out}$ of the coolant at the outlet 9 of the piping network 7 to a predefined level.

FIG. 3*b* shows the functional relationships as in FIG. 3*a*, but for a temperature of the coolant at the inlet 8 of the piping network 7 that is 35° C.

To determine a proportionality constant of the aforementioned positive directly proportional relationship, an initial reference value for the opening position of the adjustable valve 12 at a reference drive current or a reference flow rate of the suctioned gas, respectively, can be determined.

In order to obtain a reliable initial reference value, the temperature $T_{w,out}$ of the coolant at the outlet 9 of the piping network 7 must remain within a first predefined maximum absolute deviation with respect to the predefined level during a first predefined period.

Preferably, the first predefined period should be at least 60 seconds.

Preferably, the first predefined maximum absolute deviation should be maximally 1.0° C.

The initial reference value for the opening position of the adjustable valve 12 can be updated to a new reference value at predefined moments of time, when:

on the one hand, the temperature $T_{w,out}$ of the coolant at the outlet 9 of the piping network 7 remains within a second predefined maximum absolute deviation with respect to the predefined level during a second predefined time; and on the other hand, during the second predefined period, the drive current remains within a predefined maximum absolute relative deviation with respect to the reference drive current or, respectively, the second flow rate remains within the predefined maximum absolute relative deviation with respect to the reference flow rate.

Preferably, the second predefined period is at least 60 seconds.

Preferably, the second predefined maximum absolute deviation is maximally 0.8° C.

Preferably, the predefined maximum absolute relative deviation is maximally 5.0° C.

The positive directly proportional relationship between the drive current or the second flow rate of suctioned gas respectively on the one hand, and the desired value of the first flow rate on the other hand, can be used to control the opening position of the adjustable valve 12 based on the valve characteristic in the event of large relative changes of the drive current or the second flow rate of suctioned gas respectively.

In this context, 'large relative changes' means relative changes in the drive current or the second flow rate of the suctioned gas respectively which are outside twice the predefined maximum absolute relative deviation with respect to the reference drive current or the reference flow rate respectively.

For small relative changes of the drive current or, respectively, the second flow rate of the suctioned gas that fall within twice the aforementioned predefined maximum absolute relative deviation, the opening position of the adjustable valve 12 can alternatively also be controlled by means of a simple classical PI control unit based on the temperature $T_{w,out}$ at the outlet 9 of the piping network 7.

The present invention is by no means limited to the embodiments described as examples and shown in the figures, but a compressor device according to the invention can be implemented in all kinds of variants without departing from the scope of the invention as defined in the claims.

The invention claimed is:

1. A compressor device, comprising a compressor installation (2) with at least one compressor element (3*a*, 3*b*, 3*c*) for compressing a suctioned gas, the compressor element (3*a*, 3*b*, 3*c*) being driven by an electric motor (4); and a heat recuperation system (6) for recuperating heat from a compressed gas resulting from the compression of the suctioned gas, the heat recuperation system (6) comprising a piping network (7) with an inlet (8) and an outlet (9) for a coolant, and the piping network (7) at the inlet (8) or outlet (9) being provided with control means having a flow rate control state variable for modifying a first flow rate of the coolant in the piping network (7), wherein the compressor device further comprises measuring means for determining an actual value for a drive current of the electric motor (4) or, respectively, a second flow rate of the suctioned gas; and the compressor device comprises a control unit (13) configured to receive the aforementioned actual value;

determine, on the basis of the actual value, a desired value for the first flow rate at which a temperature $T_{w,out}$ of the coolant at the outlet (9) of the piping network (7) is driven to a predefined level; and, adjust the flow rate control state variable of the control means to the desired value for the first flow rate on the basis of a characteristic that provides a relationship between the flow rate control state variable of the control means and the first flow rate.

2. The compressor device according to claim 1, wherein the control means comprise an adjustable valve (12), the characteristic being a valve characteristic of the adjustable valve (12) and the flow rate control state variable being an opening position of the adjustable valve (12).

3. The compressor device according to claim 1, wherein the control unit (13) is configured so as to determine the desired value for the first flow rate on the basis of the actual value and on the basis of a relationship between the desired value for the first flow rate on the one hand, and the drive current of the electric motor (4) or the second flow rate of the suctioned gas respectively on the other hand.

4. The compressor device according to claim 3, wherein the control unit (13) is configured so as to determine the desired value for the first flow rate on the basis of the actual value and on the basis of a positive directly proportional relationship between the desired value for the first flow rate on the one hand, and the drive current of the electric motor (4) or the second flow rate of the suctioned gas respectively on the other hand.

5. The compressor device according to claim 1, wherein the compressor installation (2) is a multistage compressor installation having multiple compressor elements (3*a*, 3*b*, 3*c*).

6. The compressor device according to claim 5, wherein the compressor elements (3*a*, 3*b*, 3*c*) are driven by the electric motor (4).

7. The compressor device according to claim 5, wherein the compressor device (2) is a multistage compressor installation with multiple consecutive compressor elements (3*a*, 3*b*, 3*c*), wherein the consecutive compressor elements (3*a*, 3*b*, 3*c*) are in fluid connection with each other by means of a pipe (5) for the gas.

8. The compressor device according to claim 7, wherein the aforementioned intercoolers (10*a*, 10*b*) are mutually incorporated in parallel between the inlet (8) and the outlet (9) in the piping network (7).

9. The compressor device according to claim 7, wherein the aforementioned intercoolers (10*a*, 10*b*) are mutually incorporated in series between the inlet (8) and the outlet (9) in the piping network (7).

10. The compressor device according to claim 7, wherein downstream from the multistage compressor installation an aftercooler (11) for cooling the compressed gas is provided, the aftercooler (11) being incorporated in the piping network (7) between the inlet (8) and outlet (9) in series with respect to the intercoolers (10*a*, 10*b*).

11. The compressor device according to claim 7, wherein the multistage compressor installation comprises at least three consecutive compressor elements (3*a*, 3*b*, 3*c*) and, in the pipe (5) between each two directly consecutive compressor elements (3*a*, 3*b*; 3*b*, 3*c*) of these three consecutive compressor elements (3*a*, 3*b*, 3*c*), comprises at least one intercooler (10*a*, 10*b*).

12. The compressor device according to claim 7, wherein the multiple consecutive compressor elements (3*a*, 3*b*, 3*c*) are turbocompressor elements.

13. The compressor device according to claim 1, wherein the coolant is water.

14. The compressor device according to claim 1, wherein the compressor device incorporates a memory unit for storing corresponding reference values for, on the one hand, the flow rate control state variable of the control means and, on the other hand, the drive current of the electric motor (4) or the second flow rate of the suctioned gas at which the temperature $T_{w,out}$ at the outlet (9) of the piping network (7) is driven to the predefined level.

15. A heat recuperation system for use in a compressor device according to claim 1.

16. The compressor device according to claim 1, wherein the measuring means is configured to measure the drive current of the electric motor (4).

17. A method for controlling a compressor device, the compressor device comprising a compressor installation (2) having at least one compressor element (3*a*, 3*b*, 3*c*) for compressing a suctioned gas, the compressor element (3*a*, 3*b*, 3*c*) being driven by an electric motor (4); and a heat recuperation system (6) for recuperating heat from a compressed gas resulting from the compression of the suctioned gas, the heat recuperation system (6) comprising a piping network (7) having an inlet (8) and an outlet (9) for a coolant, and the piping network (7) at the inlet (8) or outlet (9) being provided with control means having a flow rate control state variable for modifying a first flow rate of the coolant in the piping network (7), wherein the method comprises the following steps:

determining an actual value for a drive current of the electric motor (4) or a second flow rate of the suctioned gas respectively;

determining a desired value for the first flow rate at which the coolant temperature $T_{w,out}$ at the the outlet (9) of the piping network (7) is driven to a predefined level on the basis of the aforementioned actual value; and adapting the flow rate control state variable of the control means to the desired value for the first flow rate on the basis of a characteristic which provides a relationship between the flow rate control state variable of the control means and the first flow rate.

18. The method according to claim 17, wherein the control means comprise an adjustable valve (12), the characteristic being a valve characteristic of the adjustable valve (12) and the flow rate control state variable being an opening position of the adjustable valve (12).

19. The method according to claim 17, wherein the desired value for the first flow rate is determined on the basis of the actual value and on the basis of a relationship between the desired value for the first flow rate on the one hand and the drive current of the electric motor (4) or the second flow rate of the suctioned gas respectively on the other hand.

20. The method according to claim 19, wherein the desired value for the first flow rate is determined on the basis of the actual value and on the basis of a positive directly proportional relationship between the desired value for the first flow rate on the one hand and the driving current of the electric motor (4) or the second flow rate of the suctioned gas respectively on the other hand.

21. The method according to claim 17, wherein the aforementioned predefined level lies between 60° C. and 90° C.

22. The method according to claim 17, wherein a temperature of the coolant at the inlet (8) of the piping network (7) lies between 5° C. and 35° C.

23. The method according to claim 17, wherein, when the electric motor (4) is driven with a certain reference drive current, or, respectively, when the compressor plant (2) suctions a certain reference flow rate of the gas, an initial reference value for the flow rate control state variable of the control means is stored when the temperature $T_{w,out}$ of the coolant at the outlet (9) of the piping network (7) remains within a first predefined maximum absolute deviation with respect to the predefined level during a first predefined period.

24. The method according to claim 23, wherein the first predefined period is at least 60 seconds.

25. The method according to claim 23, wherein the first predefined maximum absolute deviation is maximally 1.0° C.

26. The method according to claim 23, wherein the initial reference value for the flow rate control state variable of the control means is updated to a new reference value at predefined moments of time when, on the one hand, the temperature $T_{w,out}$ of the coolant at the outlet (9) of the piping network (7) remains within a second predefined maximum absolute deviation with respect to the predefined level for a second predefined period; and, on the other hand, during the second predefined period, the drive current remains within a predefined maximum absolute relative deviation with respect to the reference drive current or, respectively, the second flow rate remains within the predefined maximum absolute relative deviation with respect to the reference flow rate.

27. The method according to claim 26, wherein the second predefined period is at least 60 seconds.

28. The method according to claim 26, wherein the second predefined maximum absolute deviation is maximally 0.8° C.

29. The method according to claim 26, wherein the predefined maximum absolute relative deviation is maximally 5.0%.

* * * * *